United States Patent [19]

Merz

[11] 4,416,598

[45] Nov. 22, 1983

[54] ROTARY VANE PUMP WITH PRESSURE BIASED FLOW DIRECTING END PLATE

[75] Inventor: Johann Merz, Bopfingen, Fed. Rep. of Germany

[73] Assignee: Zahnradfabrik Friedrichshafen, AG., Friedrichshafen, Fed. Rep. of Germany

[21] Appl. No.: 258,413

[22] Filed: Apr. 28, 1981

[30] Foreign Application Priority Data

May 16, 1980 [DE] Fed. Rep. of Germany ..... 3018649

[51] Int. Cl.[3] ..... F04C 2/00; F04C 15/00

[52] U.S. Cl. ..... 418/132; 418/133

[58] Field of Search ..... 418/131–133

[56] References Cited

U.S. PATENT DOCUMENTS

| | | | |
|---|---|---|---|
| 2,759,423 | 8/1956 | Keel | 418/133 |
| 2,884,865 | 5/1959 | Pettibone | 418/133 |
| 3,311,064 | 3/1967 | Eichele et al. | 418/133 |
| 3,632,238 | 1/1972 | Searle | 418/15 |
| 3,787,151 | 1/1974 | Carlson | 418/133 |

*Primary Examiner*—John J. Vrablik

*Attorney, Agent, or Firm*—Zalkind & Shuster

[57] ABSTRACT

In a sliding vane type of rotary pump usable for power steering systems a seal of hour glass shape is provided between the flow directing plate, on the outlet side of the vane rotor and the outlet pressure chamber, to confine exposure of the high pressure of the outlet chamber to the downstream side of the plate within a predetermined area only partially balanced by exposure of the upstream side to such high pressure and to also isolate suction passages from the outlet chamber pressure. The result is a flexing of the flow directing plate at the center toward the pump rotor to reduce rotary clearance and permit the use of thinner and lighter weight flow directing plates.

4 Claims, 4 Drawing Figures

FIG. 2
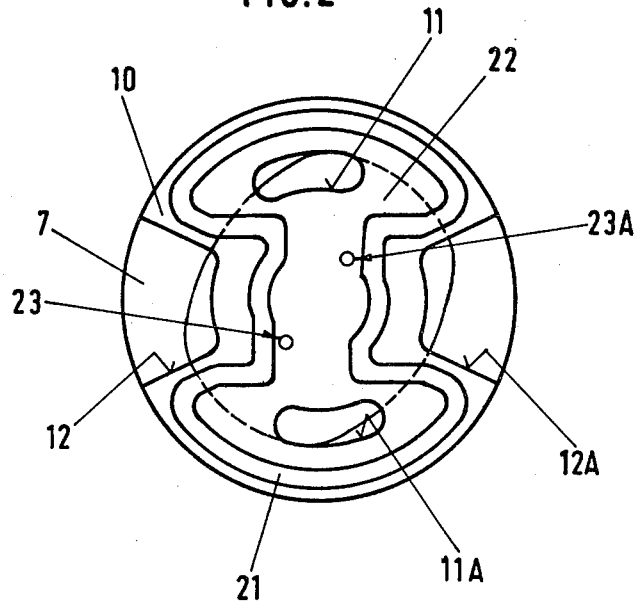
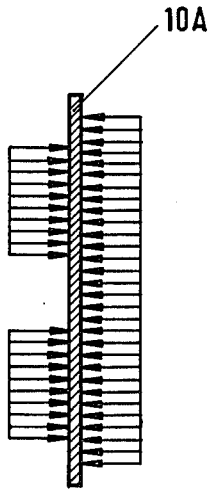
FIG. 3
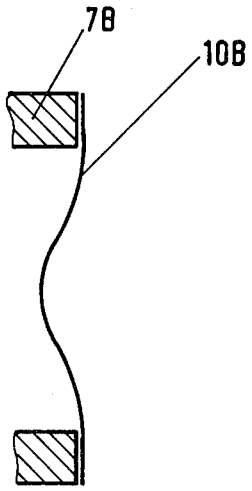
FIG. 4

ROTARY VANE PUMP WITH PRESSURE BIASED FLOW DIRECTING END PLATE

The invention relates to high pressure pump of the kind shown in my prior copending application, Ser. No. 134,126, filed Mar. 26, 1980, and assigned to the same assignee as this application.

The prior application is hereby cross-referenced to the present application.

In the prior application, a slide vane rotary pump for high pressure steering power booster is disclosed wherein the construction comprises a cam ring having an internal eccentric cam surface which causes vanes carried by a rotor to move radially so as to increase or decrease the volume of the chambers between the vanes for inducing suction inlet flow and pressure outlet flow in a well-known manner. A flow control plate, sometimes called a cheek plate, is contiguous with the rotor and has high pressure outlet passages disposed in position for outlet flow from the vane chambers. Since such plates are sometimes subject to bending due to very high pressures in a pressure chamber downstream of the plate, the area exposed to such high pressure of the chamber is reduced by a ring seal which surrounds the chamber so that the pressure of the chamber is not acting against the entire area of the flow directing plate but only within the area encompassed by the sealing ring.

The foregoing pressure area restriction facilitates a balancing of the forces acting on the flow control plate in that zone of the pump rotor exposed to high pumping pressure. For the purpose of reducing the clearance between the rotor and its vanes, on the one hand, and the flow control plate, on the other hand, to more efficiently handle increased pump pressures, it is desirable to provide for a flexing of the flow control plate to reduce such clearance and an unbalance of forces is taken advantage of for that purpose. However, thin control plates experience excessive flexing, and in the prior application the pressure area was limited by the sealing ring. Even so, under very high pressures seizing of the pump cannot be safely prevented due to excessive flexing of the plate where the clearance may become closed.

In the prior art patent to Searle, U.S. Pat. No. 3,632,238, there is shown a pressure area of the control plate divided into partial areas whereby an almost complete balancing of forces is effected. However, such an arrangement does not effect any reduction of clearance between rotor and control plate and thus there is a loss of efficiency in the pumping operation.

In the present invention, which constitutes an improvement on the prior patent referred to hereinabove, it is possible to use a thinner flow control plate and provide an optimum arrangement in a high pressure pump for operating efficiency as well as having the advantage of reduced weight because of the thinner plate.

A detailed description of the invention now follows in conjunction with the appended drawing, in which, FIG. 1 is a longitudinal cross section showing the essential components of the invention.

FIG. 2 is a plan view of interior components of the pump showing the flow control plate and the uniquely shaped sealing element among other parts.

FIG. 3 is a simplified illustration of pressure distribution on the flow control plate, and FIG. 4 shows the line of deflection of the flow control plate which results from the pressure forces illustrated in FIG. 3.

Figure 1:
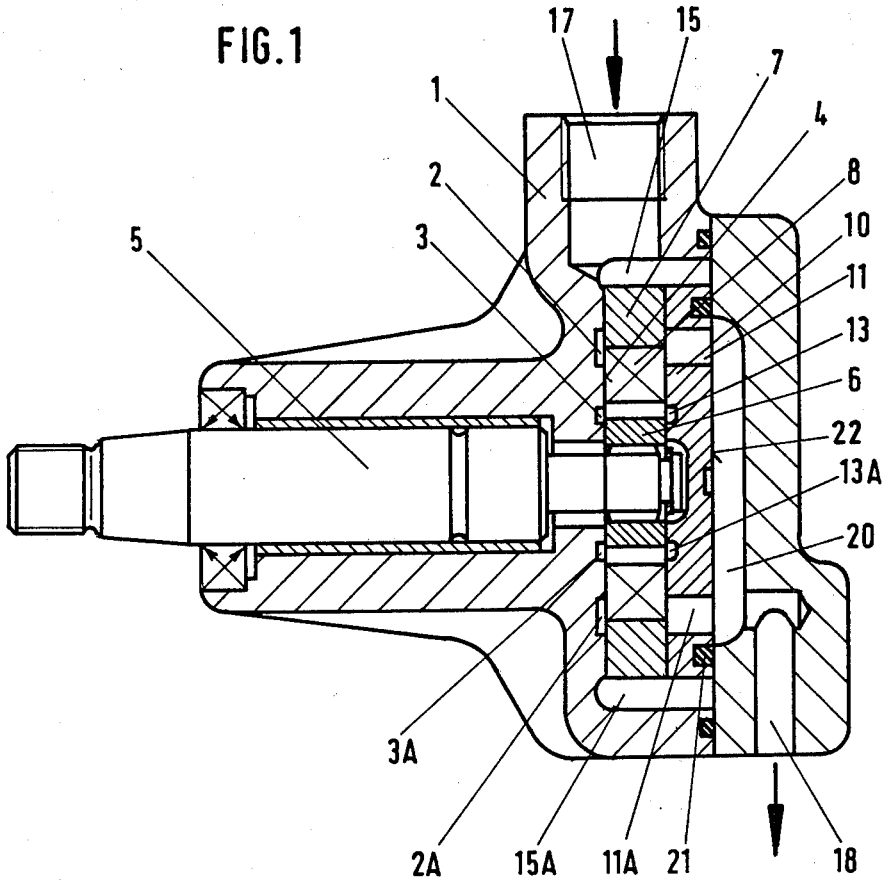

Referring to FIGS. 1 and 2 of the drawing, a pump housing 1 is illustrated having a flow control surface 4 provided with recesses 2, 3, 2A and 3A. Within the housing there is a drive shaft 5 carrying a rotor 6 splined thereto. The rotor has radial slots for carrying slidable vanes 8 within the eccentric space 7A of a cam ring 7. A separate control plate 10 is disposed contiguously against the radial outer face of cam ring 7. Such control plate has passages 11 and 11A for pressure outlet flow. The pressure areas or zones of the pump on both axial sides of plate 10 are adjacent to and surrounding outlet passages 11 and 11A. The flow control plate is also provided with suction recesses 12 and 12A for communication with the suction port 17. The channels 2, 3, 2A and 3A as disclosed in my copending application Ser. No. 134,126, aforementioned and shown in FIG. 1 are respectively aligned with passages 11 and 11A, and partially annular channels 13 and 13A recessed into the inner face of the flow control plate 10 in communication with the vane slots in the rotor 6 radially inwardly of the vanes. Fluid communication between pressure chamber 20 and channels 2,3, 2A, 3A in housing surface 4 is thereby established for pressure balance of opposite sides of rotor 6.

The recesses 12 and 12A communicate with the suction port 17 via suction chambers 15 and 15A. Oil under pressure is delivered as the vanes 8 move to reduce the volume of the vane chambers so that high pressure oil flows into a pressure chamber 20 communicating with an outlet port 18, communication from the vane chambers being via outlet passages 11 and 11A. The pressure chamber 20 is recessed into the face of an end cap as shown which closes the pump body. The end cap closes the recesses 12, 12A at the outer face of the flow control plate.

An hourlgass shaped seal 21 carried in a groove of the flow control plate 10 and engaging the inner face of the housing end cap to thereby limit a pressure area 22 on the downstream side of the flow control plate exposed to the pressure in chamber 20.

As seen in FIG. 2, the seal has radially outer chordal lobe portions on each side of the pump connected by radially inner constricted portions therebetween giving it a general hourglass shape. It will be understood that the shape of the pressure chamber 20 conforms thereto with the seal closely bounding the contour of the chamber 20.

Thus, the pressure area 22 on the flow plate 10 almost bonders the outer circumference of cam ring 7 at each side of the cam ring along the chordal portions of the seal. However, it will be noted that in the suction zone areas surrounding and adjacent to the recesses 12 and 12A, the sealing member is shaped so as to isolate such areas from high pressure. Also isolated in the suction zone are the areas opposite the radially inner ends of the vane slots. The drive shaft 5 is within the area of the pressure zone 22 on the upstream side of the flow control plate as seen in FIG. 1 including the area in the pressure zone adjacent the radially inner ends of the vane slots. This radially inner shaft zone on the upstream side of the flow directing plate 10 is not exposed to high pressure for balancing the high pressure that is on the downstream side of the plate 10 within pressure area 22.

Also included in the pressure area 22 are two bores 23 and 23A which communicate between pressure chamber 20 and the partially annular oil channels 13 and 13A.

FIG. 3 shows the distribution of the forces upon a schematically illustrated control plate 10A with the hydraulic forces in the two pressure zones on one side and the hydraulic forces in the pressure chamber on the other side.

The hydraulic forces result in a line of deflection 10B as shown in FIG. 4 for the flow control plate. The flow control plate adjoins the cam ring 7B as symbolically illustrated.

By designing the pressure area 22 in accordance with the invention, an optimum clearance arrangement for a high pressure pump is obtained between the rotor and vanes on the one hand and the flow control plate on the other hand. The advantage of a reduced thickenss and weight of the flow control plate is thus obtained by the unbalancing of forces to effect flexing in the pressure zone areas adjacent the outlet passages.

What is claimed is:

1. In a rotary vane pump including a housing (1) enclosing a suction chamber (15, 15A) and an outlet chamber (20) from which fluid is discharged under a pump pressure, a cam ring (7) mounted in the housing and having an outer peripheral portion, a rotor (6) mounted within the housing and formed with slots extending radially outward from inner ends relative to a rotor axis, a plurality of vanes (8) slidable within said slots and engageable with the cam ring to form variable volume vane chambers, and flow control surface means (4, 10) fixed to the housing on opposite axial sides of the rotor for conducting fluid from the suction chamber to the vane chambers and from the vane chambers to the outlet chamber, including a flow directing plate (10) having an upstream side confronting the rotor, a downstream side confronting the outlet chamber, circumferentially spaced suction passages (12, 12A) in fluid communication with the suction chamber, and outlet passages (11, 11A) in fluid communication with the outlet chamber, the improvement comprising seal means (21) on the flow directing plate limiting exposure of the downstream side thereof to the pump pressure within a predetermined pressure area (22) thereon having a radially outer chordal portion bordering the peripheral portion of the cam ring in spaced relation to the suction passages, and a radially inner constricted portion spaced radially inwardly of said suction passages and the inner ends of those of the vane slots aligned with the suction passages during rotation of the rotor about the rotor axis for exerting pressure forces on the downstream side of the flow directing plate unbalanced on the upstream side within a radially inner zone through which the rotor axis extends, whereby clearances between the plate and the rotor are reduced by bending of the plate with maximum flexure within said radially inner zone.

2. In a rotary vane pump as set forth in claim 1, said suction passages (12, 12A) extend through said flow directing plate and are closed downstream thereof by said housing.

3. In a rotary vane pump as set forth in claim 1, wherein said flow directing plate includes a peripheral portion supported by said peripheral portion of said cam ring leaving the radially inner zone on the plate unsupported.

4. In a rotary vane pump as set forth in claim 3 including a drive shaft connected to the rotor in axially spaced alignment with the radially inner zone on the upstream side of the flow directing plate.

* * * * *